United States Patent [19]

Fountoulakis et al.

[11] Patent Number: 4,708,779

[45] Date of Patent: Nov. 24, 1987

[54] CHEMICAL POST-TREATMENT OF SELECTIVELY GALVANIZED STEEL STRIP AND SHEET

[75] Inventors: Stavros G. Fountoulakis, Asbury, N.J.; Richard N. Steinbicker, Bethlehem, Pa.; Daniel E. Hruskoci, Michigan City, Ind.; Rajesh K. Singh, Bethlehem, Pa.

[73] Assignee: Bethlehem Steel Corporation, Bethlehem, Pa.

[21] Appl. No.: 920,635

[22] Filed: Oct. 20, 1986

[51] Int. Cl.[4] ..... C25D 5/48

[52] U.S. Cl. ..... 204/27; 204/35.1; 427/433

[58] Field of Search ..... 204/27, 28, 35.1, 15; 134/27, 28; 427/433

[56] References Cited

U.S. PATENT DOCUMENTS

| | | | |
|---|---|---|---|
| 3,523,067 | 8/1970 | Baird-Kerr et al. | 204/15 |
| 4,152,471 | 5/1979 | Schnedler et al. | 427/310 |
| 4,374,873 | 2/1983 | Piedboeuf et al. | 427/349 |
| 4,409,265 | 10/1983 | Frommann | 427/271 |
| 4,437,947 | 3/1984 | Saito et al. | 204/35.1 |
| 4,464,232 | 8/1983 | Wakano et al. | 204/28 |
| 4,483,907 | 11/1984 | Salm | 428/629 |
| 4,522,892 | 6/1986 | Shindow et al. | 428/628 |

*Primary Examiner*—John F. Niebling
*Assistant Examiner*—William T. Leader
*Attorney, Agent, or Firm*—W. B. Noll; J. I. Iverson

[57] ABSTRACT

This invention is directed to a method of treating a selectively galvanized steel strip, such as one-side electrogalvanized sheet, to improve the appearance and paintability of the non-galvanized areas of said strip. The post chemical processing of the strip, which processing does not chemically attack the zink-coated areas of the strip, comprises the steps of applying to the strip a solution of an aqueous bifluoride salt, followed thereby by rinsing said strip with a dilute caustic solution.

6 Claims, No Drawings

CHEMICAL POST-TREATMENT OF SELECTIVELY GALVANIZED STEEL STRIP AND SHEET

BACKGROUND OF THE INVENTION

The present invention is directed to a method of treating a selectively galvanized steel strip, such as one-side electrogalvanized sheet, to improve the appearance and paintability of the non-galvanized areas of said strip.

Steel has been known and used for years as a construction product. However, an accepted condition of such use, depending on the environment to which the steel is exposed, was that the steel was subject to corrosive attack. In the desire to minimize such attack, workers in the art sought out methods and protective coatings for the steel. Today, zinc is one of the most widely used metallic coatings applied to steel surfaces to protect them against corrosive attack. Two principal methods of applying such coatings are (1) hot-dipping, and (2) electroplating. Hot-dipping has the advantage of cost of application. However, hot-dipping typically results in a thick coating with a rough surface, and an intermetallic alloy interface between the steel substrate and coating overlay. As a consequence, the formability and appearance of hot-dip products is limited, thus making such product unacceptable for many applications.

In contrast, electroplated zinc (1) produces smooth, thinner coatings, (2) is applied at lower temperatures, which means the base steel is less affected by such temperatures, and (3) results in little or no formation of an intermetallic alloy interface. Thus, where forming is a critical step in the fabrication of a product, electroplated zinc is the preferred product. As a consequence, electroplated zinc, or electrogalvanized steel, has become widely accepted in the automotive industry.

More particularly, one-side electrogalvanized steel sheet is a desirable product sought by the automotive industry to protect certain body panels from inside-out perforation corrosion. Although it is easier to produce one-side coated sheet by electroplating rather than hot dipping, the process is not without its problems. As steel strip travels through the plating section, the uncoated side can be pickled by the electrolyte and it can become so highly active that it forms a light oxide stain in the final rinsing and drying sections of the line. The stain affects product appearance, and phosphatability, the latter property relating to the paintability of the product. Several post-treatment methods have been reportedly used to either prevent the formation of oxide stain or to remove it after plating. One method involves protecting the uncoated side with a flash coating of zinc near the start of the plating section and then removing it anodically. Other methods involve treating the uncoated side with acids and/or brushing. However, there are several drawbacks to these methods. The flash coating method requires electroplating equipment, consumes expensive electrical power and it may leave some small amount of coating on the surface which would adversely affect paintability. The chemical cleaning of the uncoated surface with acids requires complex hardware in order to prevent attack of the zinc coated surface by these acids. Finally, brushing may result in mechanical alteration of the surface and subsequent inferior paint appearance.

The present invention, as will become apparent from the specifications which follow, avoids the costly practices associated with such prior art post-treatment methods, without deleteriously affecting the resulting product.

SUMMARY OF THE INVENTION

This invention is directed to a method involving the chemical treatment of a selectively galvanized steel strip, such as one-side electrogalvanized sheet, to improve the appearance and paintability of the non-galvanized areas of said strip.

The typical practice for producing and finishing one-side electrogalvanized, can be summarized, as comprising:

(a) providing clean steel strip for electroplating,
(b) subjecting said strip to electrolytic deposition of zinc on one side only,
(c) cleaning the non-zinc coated side,
(d) phosphating the strip, and
(e) electrophoretic painting of the strip.

To facilitate the most desirable results for steps (d) and (e), the present invention incorporates post chemical processing of the strip, for step (c), which step does not chemically attack the zinc-coated areas of the strip. Such processing comprises the steps of applying to the strip a solution of an aqueous bifluoride salt, followed thereby by rinsing said strip with a dilute caustic solution.

DETAILED DESCRIPTION OF PREFERRED EMBODIMENT

The present invention relates to a method involving the chemical treatment of a selectively galvanized steel strip, such as one-side electrogalvanized sheet, to improve the appearance and paintability of the non-galvanized areas of said strip.

Knowledge regarding the production of electrogalvanized steel strip, one and two-sided, has been known for years. Recently, however, the automotive industry has shown a keen interest in the product. For example, one-side electrogalvanized steel sheet is now widely used by such industry to protect certain body panels from inside-out perforation corrosion. The present invention represents an improvement in the production of such product.

Since the invention hereof is directed to the treatment of one-side electrogalvanized steel sheet, step (c) as outlined below, it is not necessary to describe in detail the electrogalvanizing process. Nevertheless, to bring into perspective the contributions of this invention, it may be helpful to briefly summarize a typical practice for producing and finishing one-side electrogalvanized. Such practice can be summarized, as comprising:

(a) providing clean steel strip for electroplating,
(b) subjecting said strip to electrolytic deposition of zinc on one side only,
(c) cleaning the non-zinc coated side,
(d) phosphating the strip, and
(e) electrophoretic painting of the strip.

While the electrolytic deposition step forms no part of this invention, the electrolyte composition, plating conditions, and zinc coating thickness, followed in the development of the starting product for this invention are as follows:

Electrolyte:

300 g/l $ZnSO_4H_2O$
30 g/l $(NH_4)^2SO_4$
pH=3.5–4.5

Operating conditions:
Temperature=120–150 F.
Line Speeds=50–600 fpm
Current Density=400–600 ASF
Other:
Soluble zinc anodes
Horizontal plating cells
Coating-100 g/m$^2$ of pure zinc (one-side)

Oxide stain was present on these starting products because they were produced using only water in the post-treatment section of the coating facility.

With such starting products, an extensive investigation was conducted varying chemical solutions, concentrations, solution temperatures and immersion times. The critical facet of the investigation was to develop a post-treatment which would effectively clean the bare or uncoated surface, while not attacking the zinc coating. This was accomplished as seen from the data which follows.

Based on prior art teachings, a series of acid solution tests were conducted, the results of which are presented in TABLE I.

TABLE I

EVALUATION OF ACID SOLUTIONS

| Test No. | Type of Post-Treatment | Appearance of Uncoated Side |
|---|---|---|
| 1. | Water Rinse | Brownish Stain |
| 2. | Sulfuric Acid - 1% by wt. | Yellowish Oxide Film |
| 3. | Sulfuric Acid - 5% by wt. | Light Yellow Oxide Film |
| 4. | Sulfuric Acid - 10% by wt. | Fairly Bright |
| 5. | Sulfuric Acid - 25% by wt. | Fairly Bright |
| 6. | Sulfuric Acid - 50% by wt. | Bright |
| 7. | Sulfuric Acid - 50% by vol. | Bright |
| 8. | Hydrochloric Acid - 5% by vol. | Light Yellow Oxide Film |
| 9. | Hydrochloric Acid - 10% by vol. | Fairly Bright |
| 10. | Hydrochloric Acid - 50% by vol. | Very Bright |

In all tests, with the exception of 1 and 2, the zinc-coated side was unevenly etched and stained by the acid solution. This was clear evidence of an attack on the zinc coating.

As a result of this initial testing, a second series of tests were conducted using various organic acids and other post-treating solutions. Such tests were reported in TABLE II.

TABLE II

EVALUATION OF ORGANIC ACIDS/OTHER SOLUTIONS

| Test No. | Chemical | Concentration g/l | Uncoated Side | Effect on Zinc-Coated Side |
|---|---|---|---|---|
| 1. | citric acid | 50 | 3–4 | chemically attacked, darkened |
| 2. | citric acid | 25 | 5 | chemically attacked, darkened |
| 3. | tartaric acid | 50 | 2 | chemically attacked, darkened |
| 4. | sulfamic acid | 50 | 3 | chemically attacked, darkened |
| 5. | sulfamic acid | 25 | 4 | chemically attacked, darkened |
| 6. | oxalic acid | 25 | 8 | chemically attacked, darkened |
| 7. | monosodium phosphate | 5 | 3 | negligible change |
| 8. | monosodium phosphate | 10 | 4 | negligible change |
| 9. | monosodium phosphate | 20 | 4 | negligible chane |
| 10. | hydrochloric acid | 50% by vol. | 10 | completely dissolved |

TABLE II-continued

EVALUATION OF ORGANIC ACIDS/OTHER SOLUTIONS

| Test No. | Chemical | Concentration g/l | Uncoated Side | Effect on Zinc-Coated Side |
|---|---|---|---|---|
| 11. | sulfuric acid | 50 | 3 | completely dissolved |
| 12. | ammonium bifluoride | 5 | 7 | slight chemical attack |
| 13. | ammonium bifluoride | 10 | 8 | slight chemical attack |
| 14. | ammonium bifluoride | 20 | 8 | slight chemical attack |
| 15. | sodium bifluoride | 5 | 7 | no visual change |
| 16. | sodium bifluoride | 10 | 8 | no visual change |
| 17. | sodium bifluoride | 20 | 8 | no visual change |
| 18. | sodium bifluoride | 40 | 8 | no visual change |
| 19. | potassium bifluoride | 5 | 9 | no visual change |
| 20. | potassium bifluoride | 10 | 8 | no visual change |
| 21. | potassium bifluoride | 20 | 8 | no visual change |
| 22. | potassium bifluoride | 40 | 8 | no visual change |

(a) The following rating system was used:
10 - no stain, brightness equal to cold-rolled steel
9 - very good
8 - good
7 - fair
6 - poor
5–0 - unacceptable amount of brown stain.

As described in the last column, all of the acids, including citric, tartaric, sulfamic and oxalic chemically attacked the zinc of the coated side, darkening and staining this surface. Furthermore, they were not as effective in cleaning the uncoated steel surface as the inorganic acids. Further, while the monosodium phosphate solutions did not change the appearance of the zinc coating, it was not as effective in cleaning the uncoated steel surface.

The most acceptable solutions tested were the bifluoride containing solutions. All of the bifluoride solutions were about equally effective in removing the oxide stain from the uncoated steel surface of the one-side electrogalvanized. However, potassium and sodium bifluoride solutions did not chemically attack the zinc coating because zinc fluoride and bifluoride compounds are highly insoluble in water. The ammonium bifluoride solutions on the other hand, attacked the zinc coating slightly. This attack was probably due to the fact that soluble zinc ammonia species are formed during the post-treatment process.

In any case, the sodium and potassium bifluoride provided the improved result of cleaning the uncoated steel sheet, while not visibly attacking the zinc coating. Significant improvement in surface appearance was readily apparent following a rinsing of the test panels with cold, fresh water, immediately following the bifluoride treatment. The improvement was attributed primarily to the fact that the cold water ceased the action of the bifluoride ions and prevented excessive etching.

Notwithstanding such improvement, surface appearance of the one-side coated sheet did not quite match the appearance of the cold-rolled steel sheet. This was later, however, accomplished by introducing a neutralization step, described hereinafter as the caustic-rinse step. To determine the parameters of an effective caustic-rinse, a further series of tests were conducted. The results thereof are presented in TABLE III.

TABLE III

EFFECT OF pH OF THE CAUSTIC-RINSE STEP FOLLOWING THE BIFLUORIDE POST-TREATMENT

| Test No. | Sodium Hydroxide Concentration (g/l) | pH | Rating of Uncoated Side | Effect on Zinc Side |
|---|---|---|---|---|
| 1. | 0 | 8 | 8 | no change |
| 2. | 0.2 | 10.1 | 9 | no change |
| 3. | 0.5 | 11.5 | 10 | no change |
| 4. | 1.0 | 11.5 | 9 | no change |
| 5. | 2.0 | 11.9 | 8 | no change |
| 6. | 5.0 | 12.1 | 7 | slight chemical |
| 7. | 10.0 | 12.3 | 7 | attack increasing |
| 8. | 15.0 | 12.3 | 6 | with hydroxide |
| 9. | 20.0 | 12.5 | 6 | concentration |

From TABLE III, it was determined that a sodium hydroxide concentration of 0.2 to 2 g/l or a pH of 10 to 12 should be maintained in this caustic-rinse step to assure good surface appearance. While tests with proprietary commercial alkaline cleaning solutions indicate that other chemicals may be used in place of sodium hydroxide, the pH of the solutions should not exceed a value of 12.

By the two (2) step treatment set forth in this invention, i.e., bifluroride/caustic-rinse treatment, one-side coated product becomes equivalent in appearance and equal in phosphatability with cold-rolled steel. This was quantitatively verified, that is, the appearance of the uncoated side of the product matches that of cold-rolled steel using glossmeter and colormeter measurements, see TABLE IV.

TABLE IV

QUANTITATIVE RESULTS ON THE SURFACE APPEARANCE OF ONE-SIDE ELECTROGALVANIZED STEELS

| Type of Post-Treatment | Glossmeter Reading | Colormeter (b) Yellowness |
|---|---|---|
| CRS Control | 58.0 | Baseline |
| Water Rinse Only | 31.0 | 5.0 |
| Bifluoride + Water Base | 50.7 | N/A |
| Bifluoride + Caustic Rinse | 60.0 | 0.2 |

(a) Glossmeter reads percentage gloss (b) CRS was used for establishing baseline yellowness on the colormeter. The low reading of 0.2 on the one-side electrogalvanized sample treated with bifluoride and rinsed with caustic indicates that appearance of this sample was about the same as theCRS control sample.

As shown in TABLE IV, the percentage gloss of the product progressively increases by treating the surface first with bifluoride and then with caustic-rinse solution to a final 60% gloss vs. 58% of the cold-rolled steel used as control material. Also, yellowness of the surface, indicative of surface oxide film, disappears with the treatment as shown by the second column in TABLE IV.

A further and final improvement noted in a product produced according to this invention is the improved phosphatability of the product, see TABLE V.

TABLE V

EFFECT OF VARIOUS POST-TREATMENTS ON THE SIZE OF PHOSPHATE CRYSTALS FORMED ON THE UNCOATED SIDE OF ONE-SIDE ELECTROGALVANIZED STEEL

| Type of Post-Treatment | Phosphate Crystal Size |
|---|---|
| Bifluoride + Caustic Rinse (15 g/l NaHF2; 1 g/l NAOH) | 4–8 |
| Bifluoride + Water Rinse | 6–15 |
| Water Rinse Only | 10–40 |
| Cold Rolled Steel Control | 3–8 |
| Sulfuric Acid (1% by wt.) | 10–25 |
| Major Competitor's One-side Electrogalvanized | 10–25 |

Typically, a good phosphate coating must have fine crystals of 5–10 μm in size to provide good coverage. As shown in TABLE V, the phosphate film of one-side coated product treated with water only or dilute sulfuric acid can have a much larger crystal size of 10–40 μm. On the other hand, the bifluoride treatment decreases phosphate crystal size to 6–15 μm. The combination treatment of bifluoride plus caustic-rinse further reduces crystal size to 4–8 μm or approximately equal to that of cold-rolled steel.

SPECIFIC EMBODIMENT

Having set forth the parameters of the process according to this invention, a specific embodiment thereof is presented below.

A one-side electrogalvanized sheet panel was prepared according to known techniques, where the coated side had 100 g/m$^2$ of pure zinc, and the uncoated side exhibited an iron-oxide stained surface. Such panel was subjected to the following treatment.

1. immersion in an aqueous solution, 10 g/l sodium bifluoride, at 120° F. for 5 seconds,
2. rinsed with cold caustic solution having a pH of 11 for 3 seconds, and
3. rinsed with water and dried.

The resulting panel exhibited an excellent appearance, and possessed good phosphatability and paintability.

We claim:

1. A method of treating a selectively zinc-coated steel strip to improve the appearance and paintability of the non-coated areas of said strip, comprising the steps of applying to such areas a solution of an aqueous bifluoride salt, and followed thereby by rinsing said areas with a caustic solution having a pH between 10 and 12.

2. The method according to claim 1 wherein said salt is selected from the class of sodium bifluoride and potassium bifluoride.

3. The method according to claim 2 wherein the concentration of said salt is in the range of 5 to 15 g/l, and the pH thereof is between 3.0 and 3.5.

4. The method according to claim 1 wherein said selectively zinc-coated steel strip is an electrogalvanized strip having a coating consisting essentially of zinc on only one surface thereof.

5. The method according to claim 4 wherein said salt is selected from the class of sodium bifluoride and potassium bifluoride.

6. The method according to claim 5 wherein the concentration of said salt is in the range of 5 to 15 g/l, and the pH thereof is between 3.0 and 3.5.

* * * * *